United States Patent [19]

Carpenter

[11] Patent Number: 4,941,296

[45] Date of Patent: Jul. 17, 1990

[54] SURFACE CLEANER

[75] Inventor: James H. Carpenter, Hagerstown, Md.

[73] Assignee: Pangborn Corporation, Hagerstown, Md.

[21] Appl. No.: 48,940

[22] Filed: May 12, 1987

[51] Int. Cl.[5] ..... B24C 5/06; B24C 9/00

[52] U.S. Cl. ..... 51/433; 51/410; 51/435; 51/436; 51/434; 51/424

[58] Field of Search ..... 51/410, 433, 439, 429, 51/435, 426, 436, 434, 424, 425

[56] References Cited

U.S. PATENT DOCUMENTS

| | | | |
|---|---|---|---|
| 2,159,051 | 5/1939 | Quinn | 51/433 |
| 2,204,596 | 6/1940 | Hughes | 51/433 |
| 2,204,611 | 6/1940 | Minich | 51/432 |
| 2,241,100 | 5/1941 | Quinn | 51/433 |
| 4,207,712 | 6/1980 | Toedtli | 51/434 |
| 4,249,350 | 2/1981 | Goff | 51/435 |
| 4,394,256 | 7/1983 | Goff | 51/429 |
| 4,416,092 | 11/1983 | Nelson | 51/432 |
| 4,433,511 | 2/1984 | Swain | 51/429 |
| 4,646,481 | 3/1987 | Dickson | 51/432 |

FOREIGN PATENT DOCUMENTS

| | | | |
|---|---|---|---|
| 144960 | 6/1988 | Japan | 51/434 |
| 545650 | 4/1941 | United Kingdom | 51/435 |

*Primary Examiner*—Frederick R. Schmidt
*Assistant Examiner*—Blynn Shideler
*Attorney, Agent, or Firm*—Charles E. Brown; Charles A. Brown

[57] ABSTRACT

A surface cleaner wherein abrasive particles are directed against a surface to be cleaned, after which the abrasive particles rebound into the cleaner and return for recirculation. Several features are involved. First there is provided an accelerator for the normally gravity flowing abrasive particles to accelerate the particles towards a throwing wheel wherein the abrasive particles are spread over a greater depth of an associated throwing vane. Some of the abrasive particles will not rebound entirely up into the machine for return to the abrasive particle supply chamber. Accordingly, there is provided a separate path for the weaker rebounding abrasive particles to return to the accelerator. The throwing wheel includes a tubular hub into which one of the supporting bearings for the associated shaft is telescoped. This permits throwing wheels of different widths to be utilized. The vanes of the throwing wheel are flat vanes having at their inner ends enlargements. The vanes slide through slots with enlarged inner openings in an axial direction for mounting and removal. The vanes can be removed from the cleaner through an opening in one of the side walls thereof after a cover plate has been removed. There is also a wear plate which controls in part the direction of flow of abrasive particles from the throwing wheel. The wear plate protects part of the housing and most particularly one of the housing seals with the surface being cleaned.

17 Claims, 4 Drawing Sheets

68
104
64
182
186
184
188
180
104
166
164
168
170
106
160
162
178
158
150
90

104
208
164
164
90

16
74
82
80
14
148
140
142
138
156
158
130
132
90
134
150
152
154
158
152
124
126
128
136
122
20
32
114
18
120

SURFACE CLEANER

This invention relates in general to new and useful improvements in cleaners wherein abrasive particles are directed towards a workpiece to be cleaned. The invention particularly relates to a cleaner for cleaning surfaces including, but not limited to steel decks on aircraft carriers, concrete floors, etc. The surfaces may also be overhead surfaces and vertical surfaces.

In the past, a number of patents have been granted with respect to cleaners of this general type. These patents include U.S. Pat. Nos. 4,052,820; 4,202,142; 4,336,671; 4,364,823; 4,377,922; 4,377,923; 4,377,924 and 4,416,092.

Surface cleaners of the type to which this invention relates may be divided into two classes. One class employs more expensive, complex center feed throwing wheels. The most successful commercial surface cleaner of this type is exemplified by U.S. Pat. No. 4,377,924.

The other type of surface cleaner utilizes what is generally called a batter wheel. The most successful commercial unit of this type is that disclosed in U.S. Pat. No. 4,416,092.

This invention relates in general to surface cleaners of the batter wheel type but wherein a more efficient handling of the abrasive particles is provided for.

With the above and other objects in view that will hereinafter appear, the nature of the invention will be more clearly understood by reference to the following detailed description, the appended claims, and the several views illustrated in the accompanying drawings.

Figure 1:
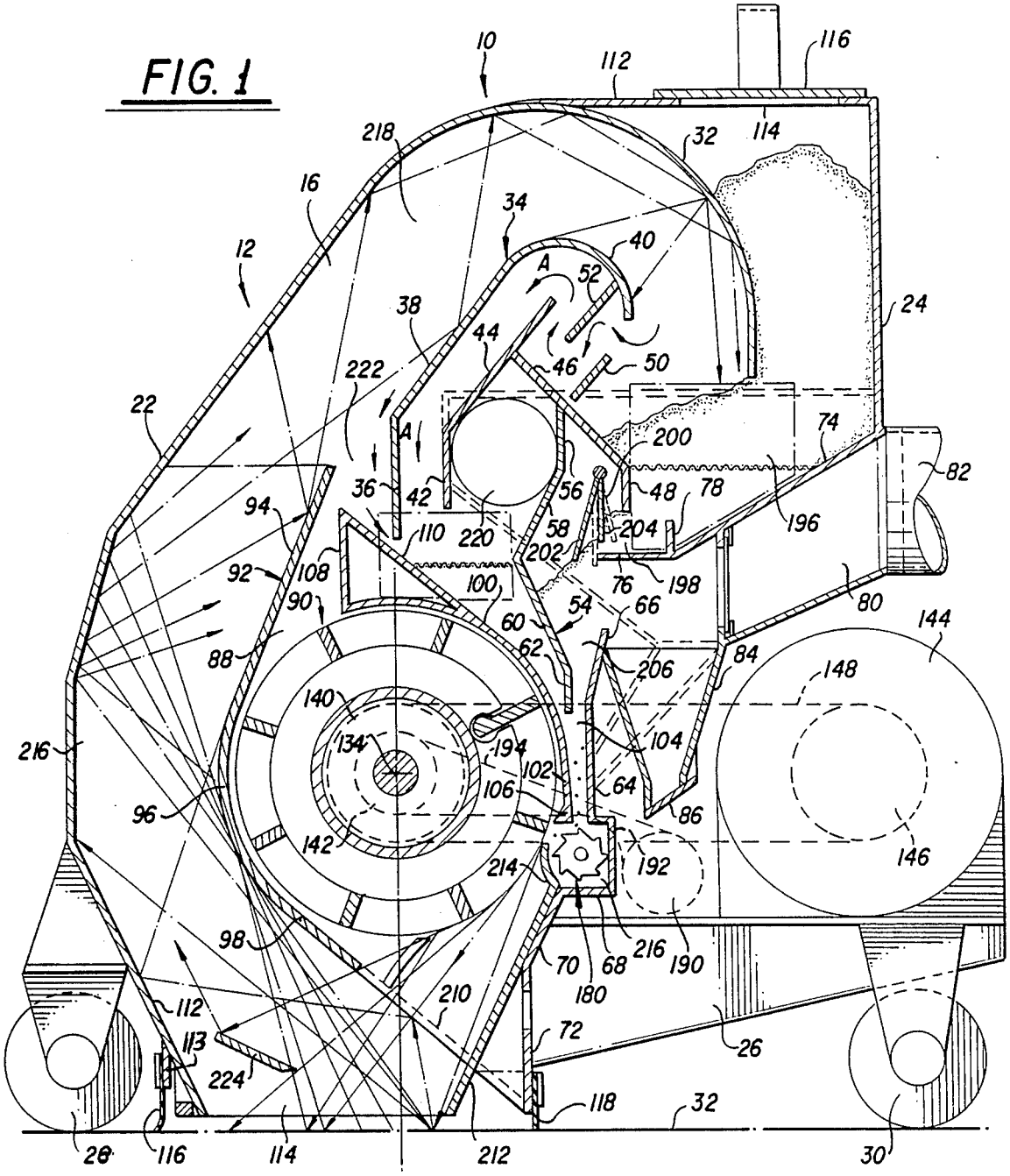
FIG. 1 is a longitudinal vertical sectional view taken through the surface cleaner showing the general details thereof including most specifically the flow of abrasive particles during operation.
Figure 2:
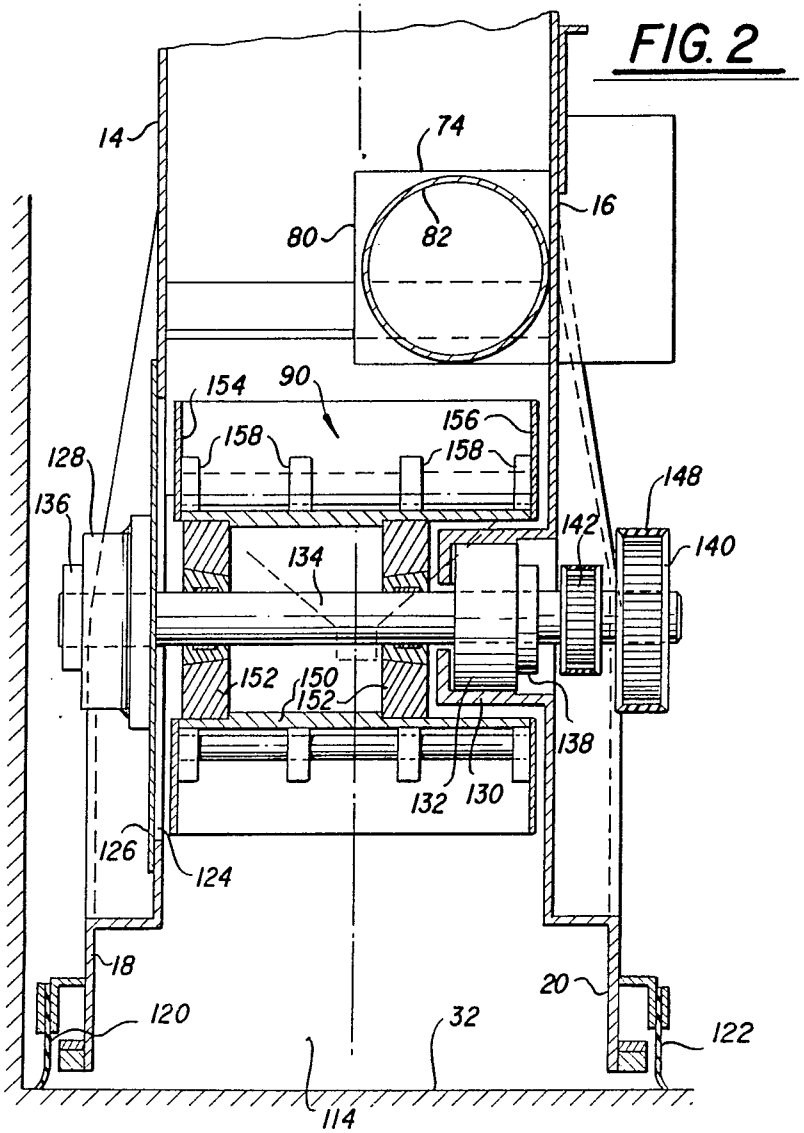
FIG. 2 is a fragmentary transverse sectional view taken generally through the center of the throwing wheel and shows further the details of the surface cleaner.

Referring now to the drawings in details, reference is first made to FIGS. 1 and 2 wherein there is illustrated a preferred embodiment of the surface cleaner, the surface cleaner being generally identified by the numeral 10. The surface cleaner 10 includes basically a housing, generally identified by the numeral 12. The housing 12 includes basically two side plates 14, 16 with the side plates 14, 16 having outwardly offset lower portions 18, 20. The side plates are joined together by a combined front and top wall member 22 and by a rear wall member 24. The rear wall member 24 has extending rearwardly from the lower portion thereof a suitable support 26.

The housing 12 is supported by a pair of front wheels 28, and a pair of rear wheels 30. The rear wheels are preferably driven in any suitable manner so as to propel the cleaner along the surface to be cleaned, the surface being identified by the numeral 32.

The interior of the housing 12 is divided into a plurality of separate areas by a plurality of baffles which will be generally described. First of all, it will be seen that the wall 22 has an upper downwardly curved portion 32 which extends into the interior of the housing 12 and functions as a baffle for directing returning abrasive particles back into a supply chamber for abrasive particles, which supply chamber will be described in detail hereinafter.

Next, there is a baffle 34 having a lower vertical portion 36, an upwardly sloping portion 38 and a reversely turned upper portion 40, the portion 40 being generally concentric with the baffle 32. The next baffle includes a lower vertical portion 42 which is parallel to the baffle portion 36 and an upper upwardly sloping portion 44 which is parallel to the baffle portion 38. The baffle portion 44 has extending downwardly to the right therefrom a baffle 46 which terminates in a vertical lower portion 48. Associated with the baffle 46 is a narrower baffle 50 which is parallel to the baffle 44. A baffle 52 depends from the baffle portion 40 between the baffle portion 44 and the baffle 50.

The baffle 46 has depending from a central portion thereof a baffle, generally identified by the numeral 54, which includes a vertical upper portion 56, a sloping intermediate portion 58, a further sloping intermediate portion 60 and a lower vertical portion 62. Adjacent the lower baffle portion 62 is an upstanding baffle 64 which has a slightly sloping upper portion 66, an intermediate chamber defining portion 68, a lower downwardly sloping portion 70 and a lower vertical portion 72.

In the upper right portion of the housing 12, there is a downwardly and to the left sloping baffle 74 which has a lower horizontal portion 76 which is in underlying spaced relation with respect to the baffle portion 48. At the right end of the baffle portion 76 is an upstanding baffle portion 78.

The baffle 74 forms the upper part of a box 80 to which there is connected a vacuum duct 82. To the left of the box 80 is a downwardly opening collector 84 having a removable lower trickle valve 86 for draining.

Generally below and to the left of the aforedescribed baffles is a chamber 88 for a throwing wheel, generally identified by the numeral 90. The chamber 88, at the left, is defined by a baffle 92 having an upper portion 94 which slopes upwardly into the right. It is joined to an arcuate intermediate portion 96, which in turn, is joined to a lower portion 98 which slopes downwardly and to the right. An upper and right portion of the chamber 88 is defined by a baffle 100 which is arcuate in outline and has an upper left end which is spaced from the baffle portion 94. The baffle 100 has a vertical lower portion 102 which is disposed parallel to the baffle portion 64 to define an abrasive particle supply passage 104. The baffle portion 102 terminates in an enlargement 106.

The baffle 100 carries at its upper left end a vertical baffle portion 108 and a sloping baffle portion 110 with the baffle portion 110 underlying and being spaced from the baffle portion 36.

The housing also includes a top wall portion 112 which is joined to the front wall 22 and which may be a continuation of the rear wall 24. An opening 114 is formed in the top wall portion for supplying abrasive particles to the surface cleaner 10. The opening 114 is normally closed by a suitable cover 116.

Referring once again to FIG. 1, it will be seen that the front wall 22 has a lower downwardly and rearwardly sloping portion 112 which defines the front side of a discharge opening 114. The wall portion 113 carries a seal forming member 116 which engages the surface 32 which is being cleaned. At this time it is also to be noted that the portion 72, which although it has been described as being a baffle portion, is an exterior wall. The portion 72 carries a sealing strip 118 forming a rear seal for the discharge opening.

Referring now to FIG. 2, it will be seen that the side wall portion 18 carries a sealing strip 120 for forming one side of the discharge opening 114, while the side wall portion 20 carries the sealing strip 122 forming the opposite side of the discharge opening 114.

Next, it will be seen that the side wall 14 has an enlarged access opening 124. The access opening 124 is normally closed by a removable plate 126 which is suitably removably secured in place by means of fasteners not shown. The plate 126 carries a shaft bearing 128.

Generally opposing the shaft bearing 128, the side wall 16 is provided with an inwardly projecting bearing support portion 130 in which there is mounted in recessed relation a shaft bearing 132. A support shaft 134 is rotatably journalled in the bearings 128, 132 and is prevented from axial shifting by means of collars 136, 138 which engage the bearings 128, 132, respectively. The right end portion of the shaft 134 carries a drive pulley or sprocket 140 and between the pulley or sprocket 140 and the collar 138 is a further pulley or sprocket 142.

Referring now to FIG. 1, it will be seen that there is mounted on the support 126 a suitable power unit 144 which carries a drive pulley or sprocket 146 which is aligned with the pulley or sprocket 140 and which is connected thereto by means of a belt 148 to rotate the shaft 134.

It will be seen that the throwing wheel 90 is of an unusual construction and includes a tubular hub 150 which carries telescoping support units 152 which mount the hub on the shaft 134.

The hub 150 is provided with a pair of annular end plates 154, 156 of which the end plate 154 is readily removable. The hub 150 also carries a plurality of axially spaced collars or rings 158 which are utilized to mount throwing blades in the throwing wheel. At this time it is to be noted that the plate 154 is in alignment with the opening 124.

Figure 3:
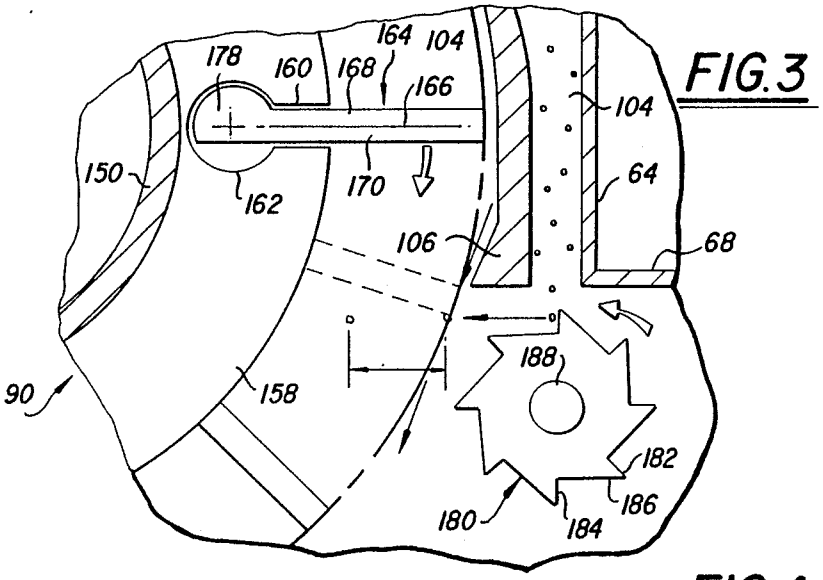
FIG. 3 is an enlarged fragmentary diagrammatic view showing the manner in which gravity fed abrasive particles are directed to the throwing wheel utilizing an accelerator wheel.

Referring now to FIG. 3, it will be seen that each collar 158 is provided with a plurality of circumferentially spaced, axial slots 160 which terminate at their radially inner end in an enlarged opening 162 which, in the illustrated embodiment, is circular in outline. The slots 160 and openings 162 in the various collars 158 are axially aligned.

The throwing wheel 90 carries a plurality of throwing vanes identified by the numeral 164. Each throwing vane 164 includes an elongated flat vane portion 166 having opposite faces 168, 170. Each vane 164 also includes a radially inner enlargement 178 which projects only from the face 168.

As will be readily apparent from FIG. 3, each vane 164 is so mounted within its respective slot 160 and opening 162 so that it cannot move radially outwardly beyond the position illustrated in FIG. 3. On the other hand, by removing the cover plate 126 and the end ring 154, one can slide the vane axially out of the throwing wheel 90 for replacement. Furthermore, by turning a vane 164 end for end, it can be reinserted so that after the face 170 thereof has become worn, the face 168 may become active.

It will be seen that by recessing the bearing 132 within the right end of the throwing wheel 90, the shaft drive elements will project a minimum. In other words, the pulleys or sprockets 140, 142 may be immediately adjacent the side plate 16 as is clearly shown in FIG. 2.

At this time it is pointed out that the housing and baffle configuration is one wherein the width of a cleaner may be varied without requiring any design changes. In other commercial units, particularly those with center feed blast wheels, this is not generally possible.

The accumulator wheel 180 has a shaft 188 which is driven from the shaft 134 in the manner best shown in FIG. 1.

The cleaner includes an idler pulley or sprocket 190 which is aligned with the pulley or sprocket 142. Further, the shaft 188, which is mounted in suitable bearings (not shown) carries a pulley or sprocket 192 over which a drive belt 194 carried by the pulleys or sprockets 142, 190 rides.

As is best shown in FIG. 3, the accelerator wheel 180 is rotated in a counterclockwise direction while the throwing wheel 90 rotates in a clockwise direction. Further, because there are the same number of teeth 182 on the accelerator wheel 180 as the number of vanes 164, there will be a separate supply of abrasive particles for each of the vanes 164. The rotation of the accelerator wheel 180 will be in timed relation to that of the throwing wheel 90 so as to provide for the timed throwing of abrasive particles towards the throwing wheel 90 for engagement by the vanes 164.

Reference is once again made to FIG. 1 wherein it will be seen that the upper right corner of the housing 12 defines a supply chamber 196 for the abrasive particles. The supply chamber 196 has an exit opening 198 between the baffle portions 48 and 76 which is controlled by the position of a two legged gate member 200. The gate member 200 has a closed position when a leg 202 thereof engages the end of the baffle portion 76. In the open position of the gate member 200, a shorter leg 204 thereof allows a limited gravity dispensing of the abrasive particles from the supply chamber 196.

The abrasive particles discharged from the supply chamber 196 fall in a stream by gravity into a chute 206 formed by the baffle portions 60, 66 and down into the abrasive particle supply passage 104. Then, as is illustrated in FIG. 3, the abrasive particles fall onto the accelerator wheel 180 and in turn are accelerated to the left into the path of a downwardly descending vane 164. The specific relationship of the flow of the abrasive particles from the accelerator wheel 180 to the throwing wheel 90 will be described in detail hereinafter.

Figure 4:
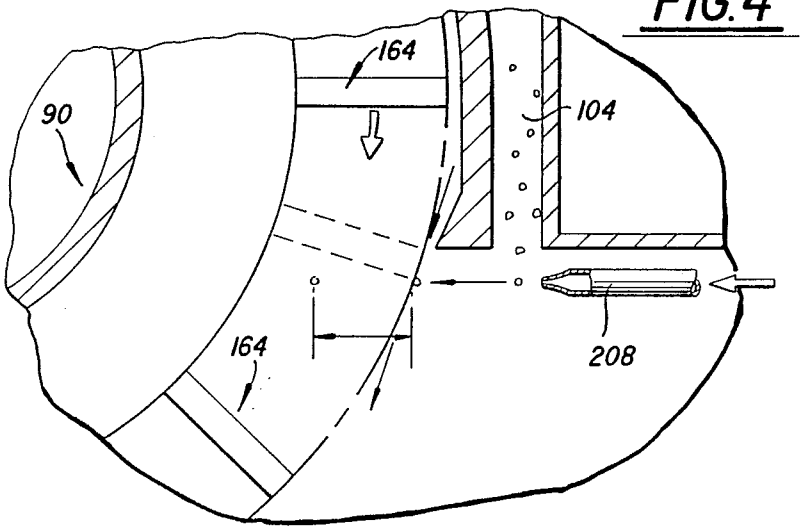
FIG. 4 is a view similar to FIG. 3 but utilizing a pneumatic accelerator.

At this time reference is made to FIG. 4 wherein in lieu of the accelerator wheel 180, other abrasive particle accelerator means may be employed. As an example, a fluid nozzle 208 may be utilized to direct the descending abrasive particles towards the throwing wheel 90 and to accelerate the particles in their movement towards the throwing wheel 90 for engagement by a throwing vane thereof.

As will be apparent from FIG. 1, the lower part of the baffle portion 98 is provided with an opening 210 which is an outlet opening for abrasive particles being thrown by the throwing wheel 90. The outlet opening 210 is generally aligned with the discharge opening 114.

In order to control the direction of flow of the abrasive particles from the throwing wheel 90, and also to protect the sealing member 118, there is a wear plate 212. The wear plate 212 is removably mounted on the baffle portion 70 and extends through the outlet opening 210 to a position at the discharge opening 114. The wear plate 212 also forms the rear boundary of the discharge opening 114.

It is to be noted that the upper part of the wear plate 212 is in the form of a curved portion 214 which together with the baffle portion 68 defines a chamber for the accelerator wheel 180. The upper end of the curved portion 214 terminates in spaced relation below the enlargement 106 on the baffle portion 104 and together therewith define an inlet opening into the chamber 88.

It will be seen that abrasive particles thrown by the throwing wheel 90 are directed against the surface 32 being cleaned and bounced upwardly therefrom into a passageway 216 defined between the lower part of the front wall 22 and the baffle 92. The return passage for the abrasive particles and material removed from the surface 32 continues as at 218 above the baffle 34 between the baffle portions 32, 40 and down into the abrasive particle supply chamber 196.

Air is drawn through the returning abrasive particles and removed material carried therewith through a torturous passage indicated by the arrows A into a vacuum line 220. The vacuum line 220, together with the vacuum line 82 are connected to a vacuum cleaner unit (not shown). Thus both the returning abrasive particles and those abrasive particles being directed to the accelerator wheel 180 are subject to a cleaning.

It is understood that not all rebounding abrasive particles will have sufficient energy to continue into the returning passageway 218 over the top of the baffle 34. Those abrasive particles which do not go this far, will drop onto the baffle 34 and will flow down the baffle 34 through an opening 222 between the baffles 34 and 92 back towards the throwing wheel 90. The abrasive particles will then land on the baffle portion 100 and will be directed back into the supply passage 104 directly to the accelerator wheel 180.

The opening 222 also defines a discharge portion through which abrasive particles may be discharged by the throwing wheel 90. Certain of the abrasive particles will bounce back up into the throwing wheel 90 and will be carried by the throwing wheel 90 behind the baffle 92 and discharged out through the opening between the baffle portions 94, 108 into the opening 222 for return to the system.

With continuing reference to FIG. 1, it will be seen that it is also feasible to provide above the discharge opening 114 a further wear plate in the form of a baffle 224 which protects the lower portion 112 of the front wall and the sealing member 116 from direct flow of abrasive particles from the throwing wheel.

It is also to be understood that there are other baffles, screens, etc. which may be illustrated, but are not specifically described because in of themselves, they form no part of this invention.

A comparison of the surface cleaner of this invention will now be made with respect to the leading prior art cleaners.

Considering units such as described in U.S. Pat. No. 4,416,092, it will be seen that the abrasive is discharged from the hopper in close proximity to the wheel blades. Since the abrasive has only a short distance to travel, the horizontal velocity feeding into the path of the blades is only 22"/sec. with a wheel speed of 3500 RPM with four blades. Further, the abrasive only penetrates 3/32" into the path of the blade. This is a serious deficiency due to the fact that many particles are being hit on a small area such that particles are not batted individually, but as gobs of abrasive several layers thick. In this case, the abrasive particles are not batted to full velocity due to particles batted being on top of each other. Additionally, velocity and direction control is lost due to the billiard ball effect of particle on particle. If the flow rate of the abrasive particles utilizing particles of a 0.0230 " diameter, is 1000#/hr./in. a blade width, each blade hits 430 particles, whereas only 183 particles can fit into an area of 3/32"×1". Further, if 8 blades are used, the area would be 3/64"×1".

Another problem with the foregoing unit is that the wear on the blade is concentrated on the 3/32" area at the tip of the blade. This creates two problems. One is that blade wear is rapid due to all of the impact energy being concentrated in a small area. The other problem is that the concentrated wear soon rounds the blade tip so that the abrasive particles hit by this rounded tip tend to billiard ball off at angles other than 90° to the blade resulting at lower abrasive velocity, higher blade wear, and difficulty in controlling the rebound angles back to the storage bin.

On the other hand, with units of the type disclosed in U.S. Pat. No. 4,377,924 there are different deficiencies. The angle of impact of all abrasive particles is approximately 60°so that the actual impact angles are compound angles of for example 60°in the side elevation and 40° in the front elevation which gives an actual 37°impact angle. At 90°in the front elevation, the actual impact angle would be 60°.

With the blast system of U.S. Pat. No. 4,377,924 it is impossible to obtain equal blast energy across the width of the cleaning path. Since the impact energy at the sides of the path is considerably less than that at 90° or at the center of the cleaning path, the cleaning rate is governed by the weakest impact energy and the area at 90°, etc. is overblasted. On typical plate blasting machines of this type, the problem is overcome by combining the tail stream of another throwing wheel to reinforce the area.

Another problem with this type of unit is that the particles which hit at 40°and other relatively shallow angles rebound more to the side than to the front, resulting in difficulty in getting the abrasive to rebound efficiently up to the return corridor to the abrasive particle supply chamber. In accordance with prior units, considerable air draft must be induced to help the particles find their way up to the rebound corridor. Yet another difficulty with the cleaner of U.S. Pat. No. 4,377,924 is that the tail stream, and to a lesser extent, the head stream, is directed at the sealing system, thus complicating the retention of abrasive particles and increasing wear on the seals.

As discussed above, and as is specifically illustrated in FIG. 3, the abrasive particles batted by the accelerator wheel have a velocity of approximately 565 in./sec. so that with the throwing wheel rotating at 3500 RPM, and with 8 blades, the abrasive can penetrate into the path of each vane up to 1.21 in. In this case, with a flow of 1000#/hr./in. width, each blade hits 215 particles of 0.0230 in. diameter particles over an area of 1.21"×1" or 1.21 in.$^2$. 2236 particles would fit single layer in this area. Thus, it can be seen that in accordance with this invention, the batting action would be very efficient with most particles being individually batted. Additionally, since 8 vanes are used and the effective area of the vanes has increased the wear area of the vanes in accordance with this invention is at a ratio of 28.5 to 1 with respect to the prior art cleaner.

Further, in accordance with this invention, the ricochet angle is much better with the result that the average particle will rebound up the return path back into the abrasive particle supply chamber. Thus the only required air velocity is that for removing the dust generated by the cleaning effect.

Figure 5:
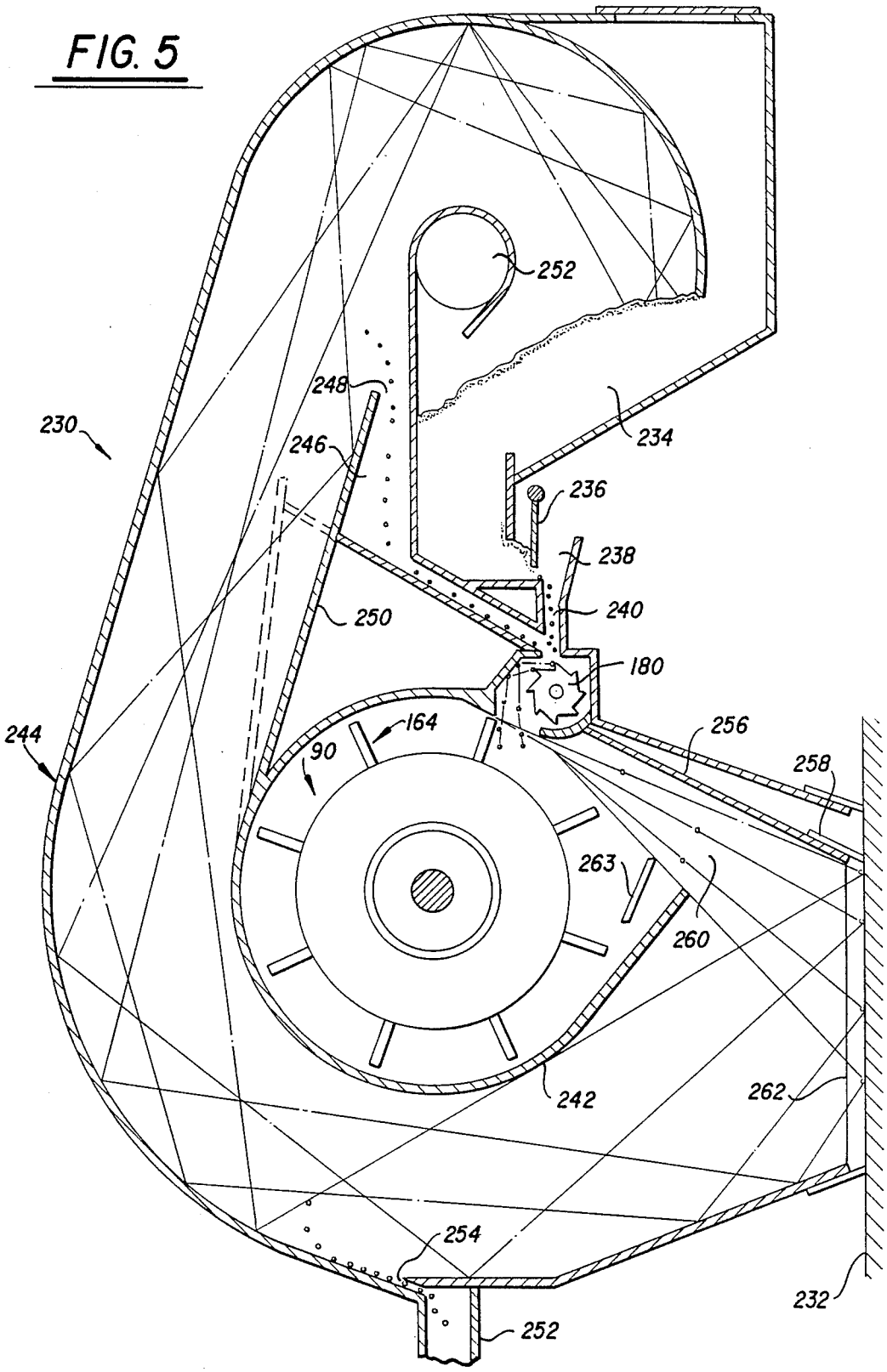
FIG. 5 is a vertical sectional view similar to FIG. 1 of a modified form of the surface cleaner for cleaning a vertical surface.

Reference is now made to FIG. 5 wherein there is illustrated a modified form of surface cleaner generally identified by the numeral 230. The surface cleaner 230 is particularly constructed to clean a vertical surface 232. In view of the specific description of the various features of the housing, baffles, etc. of the cleaner 10, it is not believed that a description of all of the baffles, etc. is required for an understanding of this modified form of cleaner. It will be seen, however, that the throwing wheel 90 is so positioned relative to the accelerator wheel 180 that abrasive particles engaged by the vanes 164 will be directed to the right and slightly downwardly. The abrasive particles will be stored in a supply chamber 234 with the flow from the supply chamber 234 being controlled by a gate 236. The abrasive particles will flow in a stream into a hopper area 238 and down through a supply passage 240 to the accelerator wheel 180. The accelerator wheel 180 will then direct the abrasive particles into the path of the vanes 164.

The throwing wheel 90 is mounted within a housing 242 and rebounding abrasive particles will flow through a lower portion of the cleaner housing 244 below the throwing wheel housing 242 and then up to the left to the top of the housing 244 for return to the abrasive particle supply chamber 234.

There is also an abrasive particle return passageway 246 having an entrance 248 which is below the top of the rebound passageway leading into the supply chamber 234. The passageway 236 leads directly to the accelerator wheel 180. If desired, the entrance may be made lower and wider by shortening and changing the angle of a baffle 250 which defines the entrance 248.

The returning abrasive particles are cleaned by means of air being drawn therethrough through a vacuum line 252 which is in an out of the way position.

Those abrasive particles and foreign matter which do not rebound to the upper portion of the housing 244 may be dispensed through a discharge tube 252 carried by a lower part of the housing 244 with there being an entrance opening 254 into the discharge tube.

The cleaner 230 also incorporates a wear plate 256 which defines the top side of the abrasive particle flow path and protects a portion of the housing 244 as well as the housing seals. If desired, the wear plate 256 may be provided with a seal 258 which supplements the housing seals.

It will be seen that particle flow from the throwing wheel 90 is through an outlet 260 in the housing 42 towards a discharge passage 262 defined by the housing 244 adjacent the surface 232 to be cleaned.

If desired, there may be a further wear plate 263 in the form of a baffle which also serves to define the flow path of the abrasive particles from the throwing wheel, the baffle 263 deflecting particles engaging it back to the throwing wheel 90.

It is to be understood that the surface cleaner 230 may be mounted on suitable wheels or may otherwise be supported with respect to the surface 232.

Figure 6:
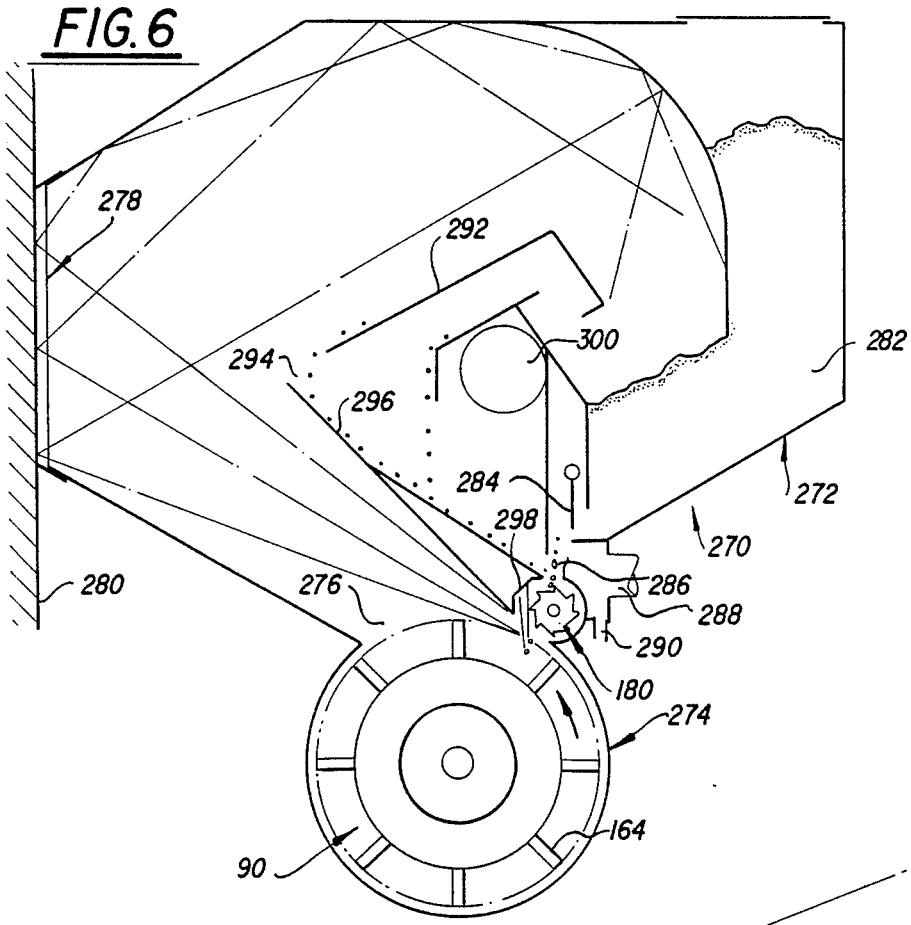
FIG. 6 is a schematic vertical sectional view taken through another form of surface cleaner for cleaning a vertical surface.

Referring now to FIG. 6, it will be seen that there is illustrated another form of surface cleaner of which only the basic elements will be specifically described.

The cleaner 270 includes a housing 272 of which a lower portion defines a generally cylindrical housing 274 for the throwing wheel 90. The housing 274 has an outlet 276 which is aligned with a discharge opening 278 through which abrasive particles may be directed to a vertical surface 280 to be cleaned.

In this instance, the throwing wheel 90 rotates in a counterclockwise direction as does the accelerator wheel 180. The accelerator wheel 180 is positioned above the throwing wheel 90 and receives abrasive particles from an abrasive particle supply chamber 282 through an exit passage controlled by a gate member 284 down a supply passage 286. Air is drawn through the abrasive particles flowing to the accelerator wheel 180 through a vacuum line 288 with any fallout of sand or like material from the air flowing into the vacuum line 288 passing into a discharge tube 290.

Rebounding abrasive particles will rebound into the upper part of the housing 272 and back into the supply chamber 282. Those abrasive particles which do not have sufficient energy to rebound into the supply chamber 282, will fall on a baffle member 292 and pass into an opening 294 onto a baffle 296 which directs those returning abrasive particles to the accelerator wheel 180. At this time it is pointed out that the lower part of the baffle 296 defines a rebounding surface 298 against which the abrasive particles from the accelerator wheel 180 are thrown and rebound into the path of the vanes 164.

The returning abrasive particles are also cleaned by way of a vacuum line 300 which opens into a concealed area to which the air must flow through a torturous passage but through the returning abrasive particles.

Figure 7:
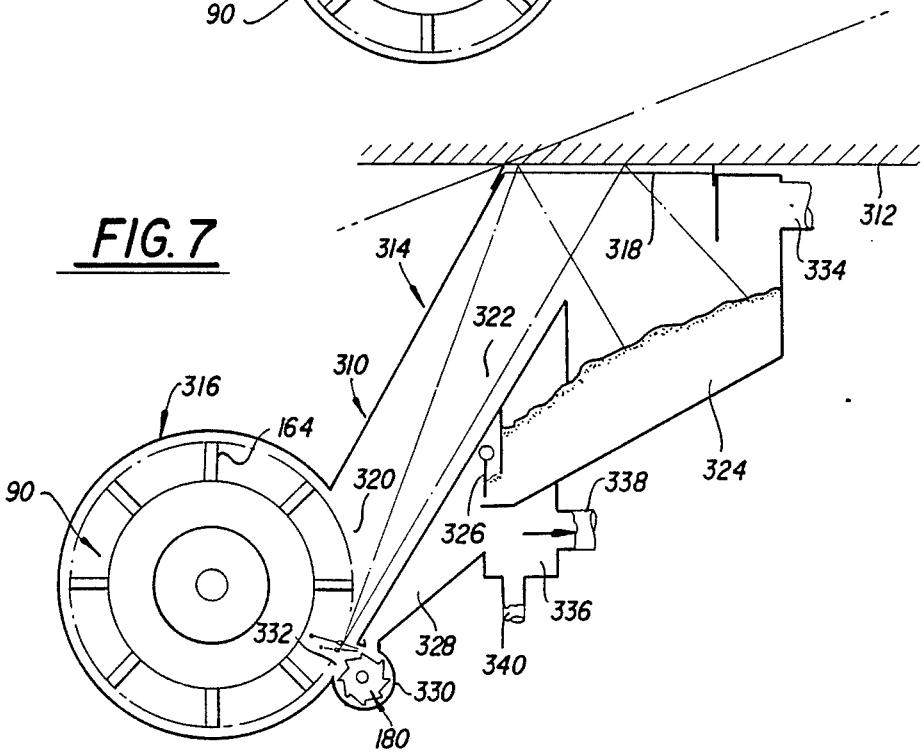
FIG. 7 is a further schematic vertical sectional view showing a further modification of the surface cleaner for cleaning the underside of a horizontal surface.

Reference is now made to FIG. 7 wherein there is illustrated a further form of surface cleaner, generally identified by the numeral 310 and being specifically constructed to clean the underside of a horizontal surface 312. The cleaner 310 includes a housing 314 of which a portion defines a housing 316 for the throwing wheel 90.

The top of the housing 314 has a discharge opening 318 opening towards the surface 312. The housing 316 has an outlet 320 aligned with the discharge opening 318 and in communication with the discharge opening 318 through an elongated abrasive particle flow passage 322. .The upper right portion of the housing 314 defines an abrasive particle supply chamber 324 and flow of abrasive particles from the supply chamber 324 is effected by a gate member 326. The abrasive particles from the chamber 324 flow into a supply passage 328 to the accelerator wheel 180 which is mounted within a housing 330. Abrasive particles are impelled into the path of the vanes 164 through an inlet 332 in the housing 316.

The upper right hand part of the housing 314 is supplied with a vacuum line 334 to withdraw dust and other foreign matter from the returning abrasive particles. Further, the stream of abrasive particles flowing from the supply chamber 324 has air drawn therethrough into a chamber 336 which is provided with a vacuum line 338. The bottom of the chamber 336 is provided with a discharge tube 340.

Although the cleaners 270 and 310 have only been schematically illustrated, it will be seen that the principles of operation thereof are fully illustrated and have been fully described. It is to be understood that the units are self-contained with there being the necessary vacuum cleaner systems and supports as well as the drive unit for the throwing wheel 90 and the accelerator wheel 180.

Although only several preferred embodiments of the surface cleaner have been specifically illustrated and described herein, it is to be understood that minor variations may be made in the surface cleaner without departing from the spirit and scope of the invention as defined by the appended claims.

I claim:

1. In combination with a rotating abrasive particle primary batting wheel having batting vanes with outer ends, a gravity abrasive particle supply passage for providing downwardly flowing abrasive particles, and a second batting wheel for intercepting flowing abrasive particles and batting such abrasive particles radially into said primary batting wheel between said batting vane outer ends and into the path of each batting vane at an accelerated speed.

2. The combination of claim 1 wherein said batting wheel includes a central hub, vane anchoring means carried by said central hub, said vane anchoring means including a radial slot for each vane, each radial slot terminating at a radially inner end thereof in an enlarged opening, each radial slot and enlarged opening through one end of said central hub, and each vane including a generally flat vane portion and an enlargement at an inner end of said vane portion whereby each vane may be mounted and removed relative to said batting wheel hub by axial sliding movement.

3. The combination of claim 1 wherein said second batting wheel has batting vanes with accelerator faces, and the number of batting vanes and the number of acceleration faces are the same.

4. The combination of claim 3 together with drive means interconnecting said primary batting wheel and said second batting wheel for providing a timed flow of abrasive particles radially from said second batting wheel to said primary batting wheel between adjacent ones of said batting vanes.

5. The combination of claim 1 together with drive means interconnecting said primary batting wheel and said second batting wheel for providing a timed flow of abrasive particles radially from said second batting wheel to said primary batting wheel between adjacent ones of said batting vanes.

6. The combination of claim 1 wherein there are baffle means in an abrasive particle flow path between said second batting wheel and said primary batting wheel for directing accelerated abrasive particles from said second batting wheel radially into the path of said batting vanes.

7. The combination of claim 1 wherein each batting vane includes a flat blade portion having a mounting end remote from said accelerator means in the form of an anchoring enlargement extending from and beyond an extreme end of said flat blade portion in a lengthwise direction.

8. The combination of claim 7 wherein said flat blade portion has opposite working faces, and said anchoring enlargement projects from only one of said faces.

9. The combination of claim 7 wherein said batting wheel has an axis of rotation and batting vane anchoring means in the form of a radial slot for each batting vane, each of said slots terminating at a radially inner end thereof in an enlarged opening disposed parallel to said axis of rotation, and each radial slot and enlarged opening opening axially through one end of said batting wheel whereby said batting vanes are removable and insertable in an axial direction.

10. The combination of claim 1 wherein there is a housing in which said batting means and said accelerator means are mounted, said housing has a discharge opening for opposing a surface to be cleaned, an abrasive supply chamber within said housing and connected to said gravity abrasive particle supply passage for continuously supplying abrasive particles to said supply passage, and baffles within said housing for controlling return flow of abrasive particles rebounding from a surface being cleaned.

11. The combination of claim 10 wherein said baffles define a chamber for said batting wheel, said chamber including an inlet opening from said accelerator means, an outlet opening directed towards said discharge opening, and a separate rebounding abrasive particle discharge opening from said chamber for discharging rebounding abrasive particles re-engaged by said batting wheel.

12. The combination of claim 10 wherein said batting wheel has a tubular center, said housing including a side plate having a portion telescoped into one end of said tubular center, and a shaft bearing for said batting wheel mounted within said side plate portion and within the confines of said batting wheel, said housing side plate portion position and said shaft bearing mounting providing for a side of said discharge to be adjacent a side of said housing for cleaning surfaces adjacent to obstruction.

13. The combination of a rotating abrasive particle batting wheel, a gravity abrasive particle supply and rotary batting accelerator means for intercepting falling abrasive particles and directing said abrasive particles into said batting wheel, said batting wheel having circumferentially spaced and radially extending batting vanes lying in a general plane and having free ends, said gravity abrasive particle supply including means for providing abrasive particles falling in a path lying in the general plane of said batting vanes and spaced from the path of said batting vane free ends, and said batting accelerator means being positioned adjacent the path of said batting means free ends and in the path of falling abrasive particles and forming vane for directing such falling abrasive particles at an accelerated speed in said general plane of said batting vanes into said batting wheel between adjacent rotating batting vanes.

14. In combination with a rotating abrasive particle batting wheel having batting vanes, a gravity abrasive particle supply passage, and accelerator means for intercepting falling abrasive particles and directing such abrasive particles into the path of said batting vanes at an accelerated speed, a housing in which said batting wheel and said accelerator means are mounted, said housing having a discharge opening for opposing a surface to be cleaned, an abrasive supply chamber within said housing and connected to said gravity abrasive particle supply passage for continuously supplying abrasive particles to said supply passage, and baffles within said housing for controlling return flow of abrasive particles rebounding form a surface being cleaned, said baffles defining a chamber for said batting wheel, said chamber including an outlet opening directed towards said discharge opening, said baffles including a wear plate extending generally from said accelerator means to said discharge opening.

15. In combination with a rotating abrasive particle batting wheel having batting vanes, a gravity abrasive particle supply passage, and accelerator means for intercepting falling abrasive particles and directing such abrasive particles into the path of said batting vanes at an accelerated speed, a housing in which said batting wheel and said accelerator means are mounted, said housing having a discharge opening for opposing a surface to be cleaned, an abrasive supply chamber within said housing and connected to said gravity abrasive particle supply passage for continuously supplying abrasive particles to said supply passage, and baffles within said housing for controlling return flow of abrasive particles rebounding from a surface being cleaned, said baffles being arranged to form baffle means for primarily directing rebounding abrasive particles into said abrasive supply chamber and secondarily directing rebounding abrasive particles to said accelerator means.

16. The combination of claim 15 wherein said baffles define separate return paths to said abrasive particle supply chamber and the said accelerator means, each of said return paths having an entrance, and said entrances being offset wherein differently rebounding abrasive particles enter different ones of said entrances.

17. The combination of claim 10, wherein the offset of said entrances is vertical with said entrance to said return path to said accelerator means being the lower entrance for receiving rebounding abrasive particles having insufficient speed to reach the other of said entrances.

* * * * *